US005362261A

United States Patent [19]

Puerner

[11] Patent Number: 5,362,261

[45] Date of Patent: Nov. 8, 1994

[54] HYBRID CONNECTOR

[75] Inventor: Dean A. Puerner, Maracopa, Ariz.

[73] Assignee: The Whitaker Corporation, Wilmington, Del.

[21] Appl. No.: 86,077

[22] Filed: Jun. 30, 1993

[51] Int. Cl.[5] ..... H01R 13/506

[52] U.S. Cl. ..... 439/752; 439/689

[58] Field of Search ..... 439/686, 752, 689, 695

[56] References Cited

U.S. PATENT DOCUMENTS

| | | | |
|---|---|---|---|
| 3,721,943 | 3/1973 | Curr | 439/877 |
| 3,957,337 | 5/1976 | Damiano | 439/682 |
| 4,342,495 | 8/1982 | Bennett et al. | 439/689 |
| 4,664,456 | 5/1987 | Blair et al. | 439/108 |
| 4,758,536 | 7/1988 | Miller et al. | 439/138 |
| 5,044,962 | 9/1991 | Tomes et al. | 439/689 |
| 5,080,604 | 1/1992 | Rider et al. | 439/357 |
| 5,154,618 | 10/1992 | Nikoloff et al. | 439/67 |
| 5,234,353 | 8/1993 | Scholz et al. | 439/289 |

FOREIGN PATENT DOCUMENTS

| | | | |
|---|---|---|---|
| 4019974 | 1/1992 | Japan | 439/752 |

OTHER PUBLICATIONS

AMP Catalog #65408; "High-Current Contacts for Metrimate Connectors"; 2 pages; AMP Incorporated, Harrisburg, Pa.

AMP Catalog #65141 (Issued Mar. 1992); "High Current Product"; 2 pages; AMP Incorporated, Harrisburg, Pa.

*Primary Examiner*—Gary F. Paumen

*Attorney, Agent, or Firm*—Katherine A. Nelson; Robert J. Kapalka

[57] ABSTRACT

A forward housing member for an electrical connector of the type having an array of contacts disposed within a dielectric housing assembly includes a generally planar body section and an array of contact receiving passageways extending therethrough from a forward face to a rearward face thereof, the forward housing passageways having a selected dimension and a selected location. The forward housing member is assembled to a forward face of a discrete rearward housing member such that the passageways are generally aligned with corresponding passageways of the rearward housing member and forward contact sections of the contacts in the corresponding rearward passageways extend in a close fit into the passageways of the forward housing member. The forward housing member defines a mating face of the resultant connector assembly wherein only the forward housing member need be precisely molded for forward sections of the contacts to at least be exposed for electrical connection at precisely located contact positions across the mating face.

14 Claims, 11 Drawing Sheets

HYBRID CONNECTOR

FIELD OF THE INVENTION

The present invention is directed to electrical connectors and, more particularly, to hybrid connectors.

BACKGROUND OF THE INVENTION

Today's sophisticated electronic equipment often requires electrical interconnections for multiple levels of power and numerous sense and signal lines to operate and communicate among the various equipment and sub-assemblies within the entire system. A fairly common requirement for a pluggable power supply entails a primary power input rated at up to 35 amperes, a low voltage dc output capable of 150–200 amperes, a secondary low voltage output capability for perhaps 15 amperes, and a communications and control interface with 30, 40, or more sense and signal lines. Rather than use a variety of connectors, it is highly desirable to have a single connector that carries the signal lines plus a plurality of different sized electrical terminals, each size being capable of carrying different levels of power. In many applications it is desirable that the connector be capable of blind mating.

Connectors carrying power, also must meet certain safety requirements. In today's global market, it is also desirable that connectors be able to meet international as well as national safety standards promulgated by, for example, the Underwriters' Laboratories (UL), the International Electrotechnical Commission (IEC), and the Verein Deutscher Electrotechnischie (VDE). One particular VDE standard that must be met is that the connector must be designed so that an articulate probe (finger probe test) having a precise shape cannot be inserted into the connector to engage a power contact therein.

It is also desirable that the connector be suitable for use in drawer applications, and therefore, be blind mateable.

SUMMARY OF THE INVENTION

The multi-level hybrid connector of the present invention includes a receptacle connector assembly and a plug connector assembly. Each of the assemblies includes a transverse forward housing member, having array of terminal receiving passageways extending therethrough, a rearward housing member having a like array of contact receiving passages extending axially therethrough and means for securing the forward member to the rearward member. The rearward housing further includes a plurality of electrical terminals each disposed in a respective terminal receiving passageway. The forward housing member is an integral plate-like member molded of dielectric plastic with the passageways extending therethrough from a forward face to a rearward face. Forward housing passageways have a selected dimension and a selected location. The terminal receiving passageways of the rearward housing member include contact engaging surfaces adapted to hold a respective contact therein. When the forward housing member is assembled to a forward face of the rearward housing member, the passageways of the forward member are generally aligned with the corresponding passageways of the rearward housing member.

The terminal members of the rearward housing member have forward contact sections extending at least into the passageways of the forward housing member in a close fit. The forward housing member defines a mating face of the resultant connector assembly wherein only the forward housing member needs to be precisely molded for forward sections of the terminals to be at least exposed for electrical connection at precisely located contact positions across the mating face. In the preferred embodiment, the means for securing the forward housing member to the rearward housing member includes a plurality of integral latch arms extending along two opposing sides of the forward housing member that are received into complementary recesses of the rearward housing member.

It is an object of the present invention to provide a hybrid connector having a plurality of different terminals capable of carrying signals as well as multiple levels of power.

It is a further object of the invention to provide a hybrid connector that will meet certain safety dictated creepage and clearance requirements of UL1950/IEC 950, as well as providing operator protection against contact with exposed and energized metal parts.

It is also an object of the invention to provide a multi-level hybrid connector that can be used for drawer applications.

BRIEF DESCRIPTION OF THE DRAWINGS

FIG. 6 is a staggered top transverse section of the connector of FIG. 4 with the forward housing exploded from the rearward housing.

DETAILED DESCRIPTION OF THE DRAWINGS

Figure 1:
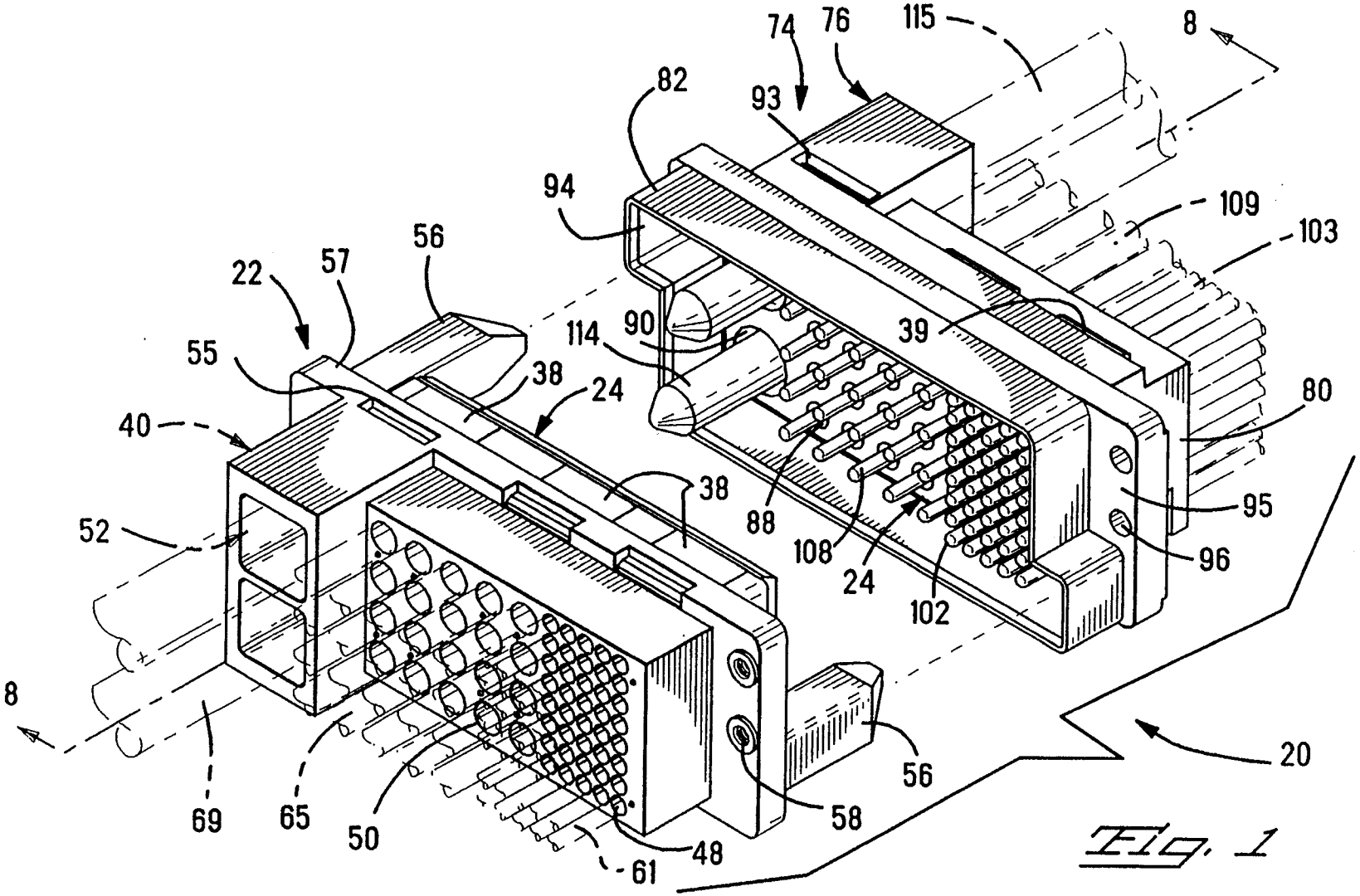
FIG. 1 is an exploded perspective view of a mateable connector assembly with contacts and cable shown in phantom.

Referring now to FIGS. 1 through 4, mateable connector assembly 20 includes a first connector 22 and a second connector 74. For purposes of illustrating the invention, mating connectors 22 and 74 are shown as cable connectors. Wires 61, 65 and 69 terminated to respective electrical terminals in first connector 22 and wires 103, 109 and 115 terminated to respective electrical terminals in connector 74 are shown in phantom in FIG. 1.

Figure 2:
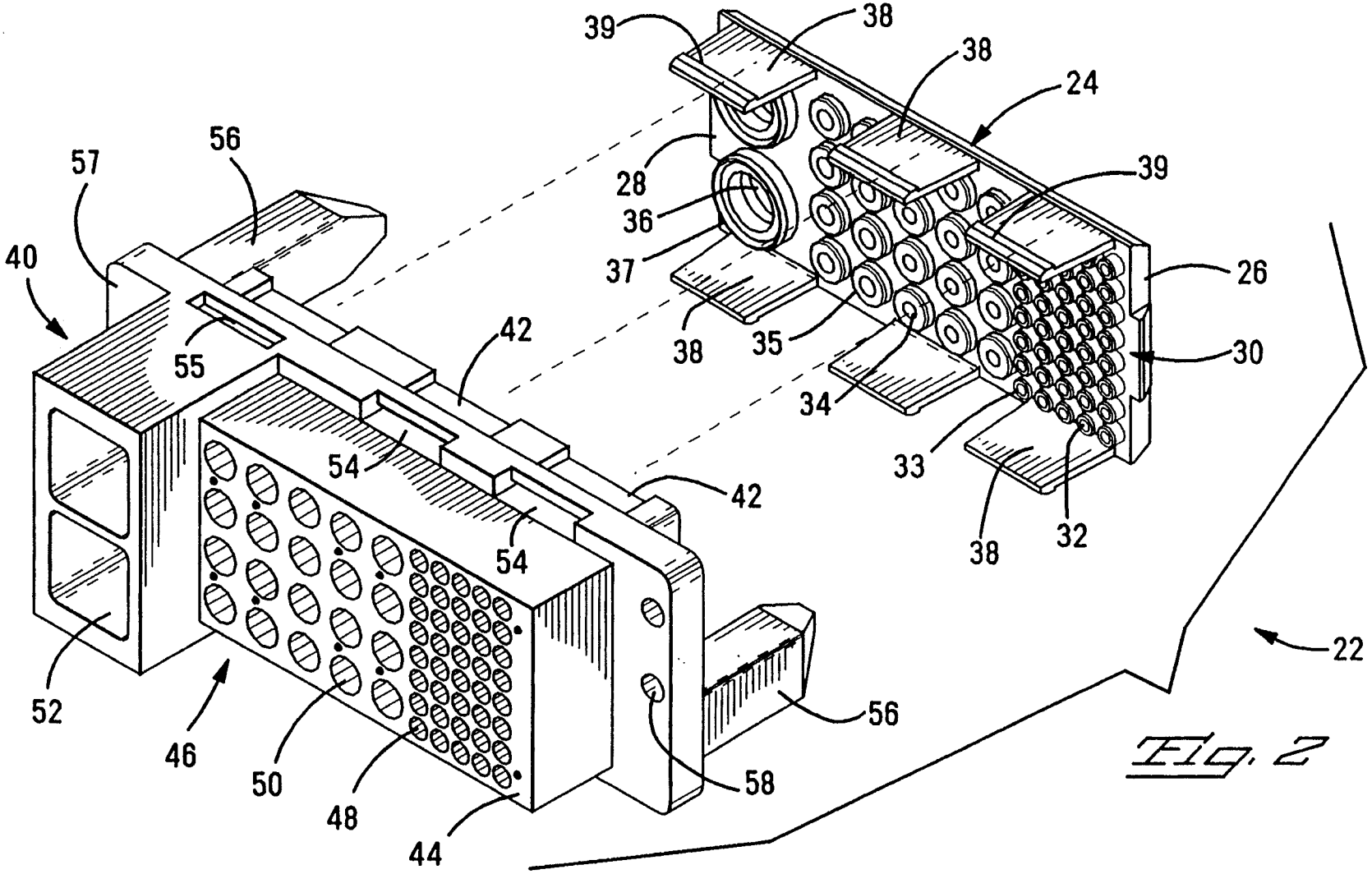
FIG. 2 is an exploded view of one half of the mating connector of FIG. 1 with the forward housing exploded from the rearward housing and having the electrical terminals removed therefrom.
Figure 3:
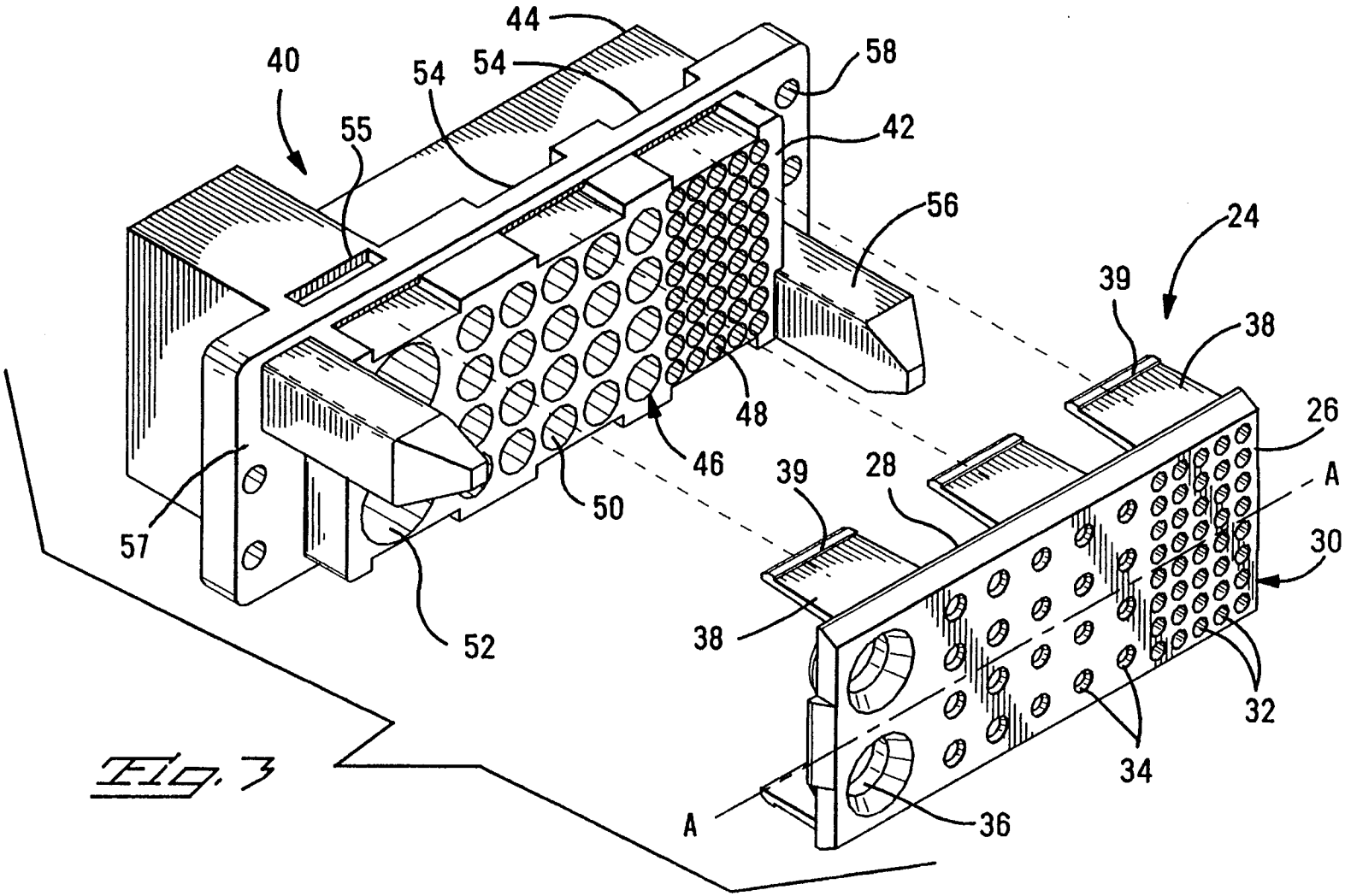
FIG. 3 is an exploded view of the connector of FIG. 2 from the mating side thereof.

The structure of the first connector 22 is best seen by referring to FIGS. 2 and 3. First connector 22 includes a forward housing member 24 and a rearward housing member 40. Forward housing member 24 is a transverse plate-like member of limited axial dimension having a front face 26, a rear face 28 and an array of passageways 30 extending therethrough. Array 30 includes a first group of passageways 32, a second group of passageways 34 and a third group of passageways 36, each of the groups being of different sized passageways to accommodate electrical terminals or contacts of different sizes. As shown in FIG. 3, each passageway within the respective groups 32, 34, 36 include support extensions 33, 35, 37 respectively on the rear face 28 thereof. The support extensions further provide the required insulation and spacing between adjacent contacts to meet the desired safety standards. The forward housing passageways have a selected dimension and a selected location. Preferable, the leading ends of the passageways are chamfered to facilitate mating with complementary contact sections of terminals in a mating connector.

Forward housing member 24 further includes a plurality of latch arms 38 extending rearwardly from the rear face 28. Each of the latch arms 38 includes an outwardly extending lip 39 used in securing forward housing member 24 to rearward housing member 40 as more fully explained below. As can be shown in FIGS. 2 and 3, the array of passageways 30 are preferably located symmetrically along at least one transverse dimension bisecting the body section, such as the transverse axis shown as line A—A in FIG. 3. Thus, the same forward housing member 24 can be used for both the first and second connectors 22 and 74. The forward housing member 24 defines a mating face of the resulting connector assembly 22 wherein only the forward housing member 24 needs to be precisely molded for forward contact sections of the terminals to at least be exposed for electrical connection at precisely located contact positions across the mating face.

Figure 13:
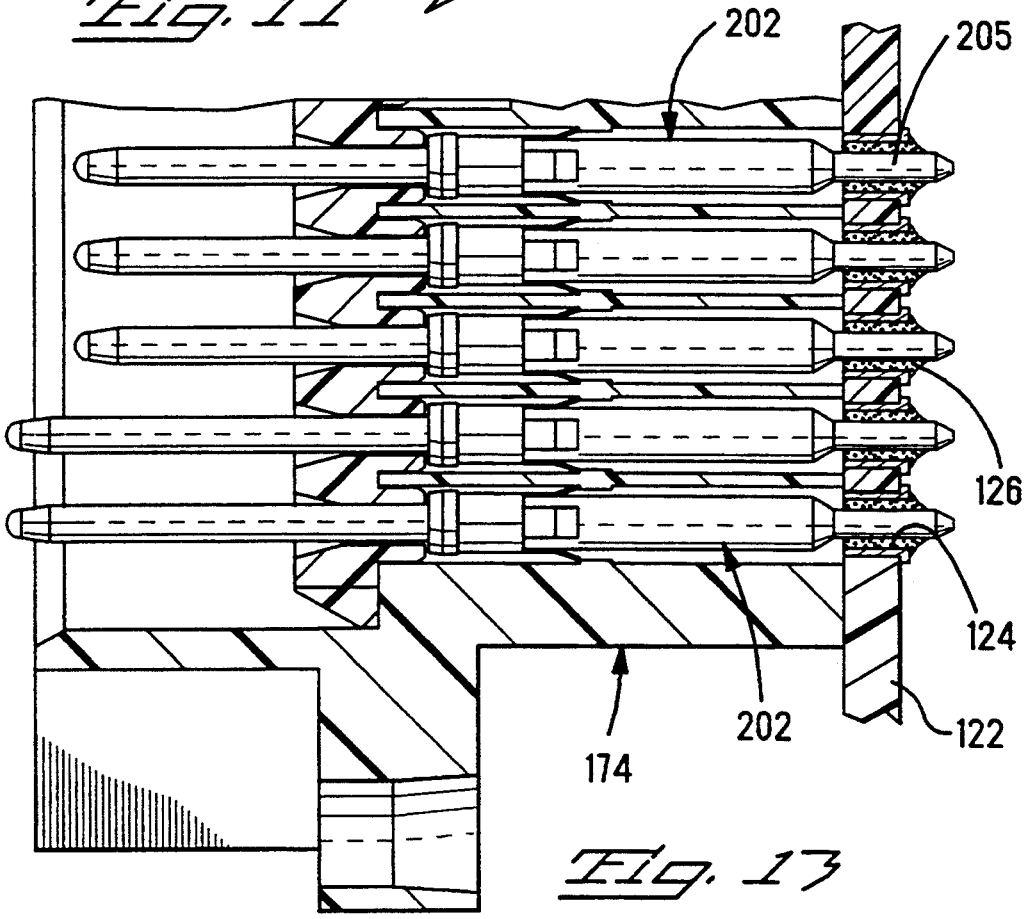
FIG. 13 is a cross-sectional view of a fragmentary portion of the connector assembly of FIG. 12 illustrating the connector mounted to the circuit board.
Figure 12:
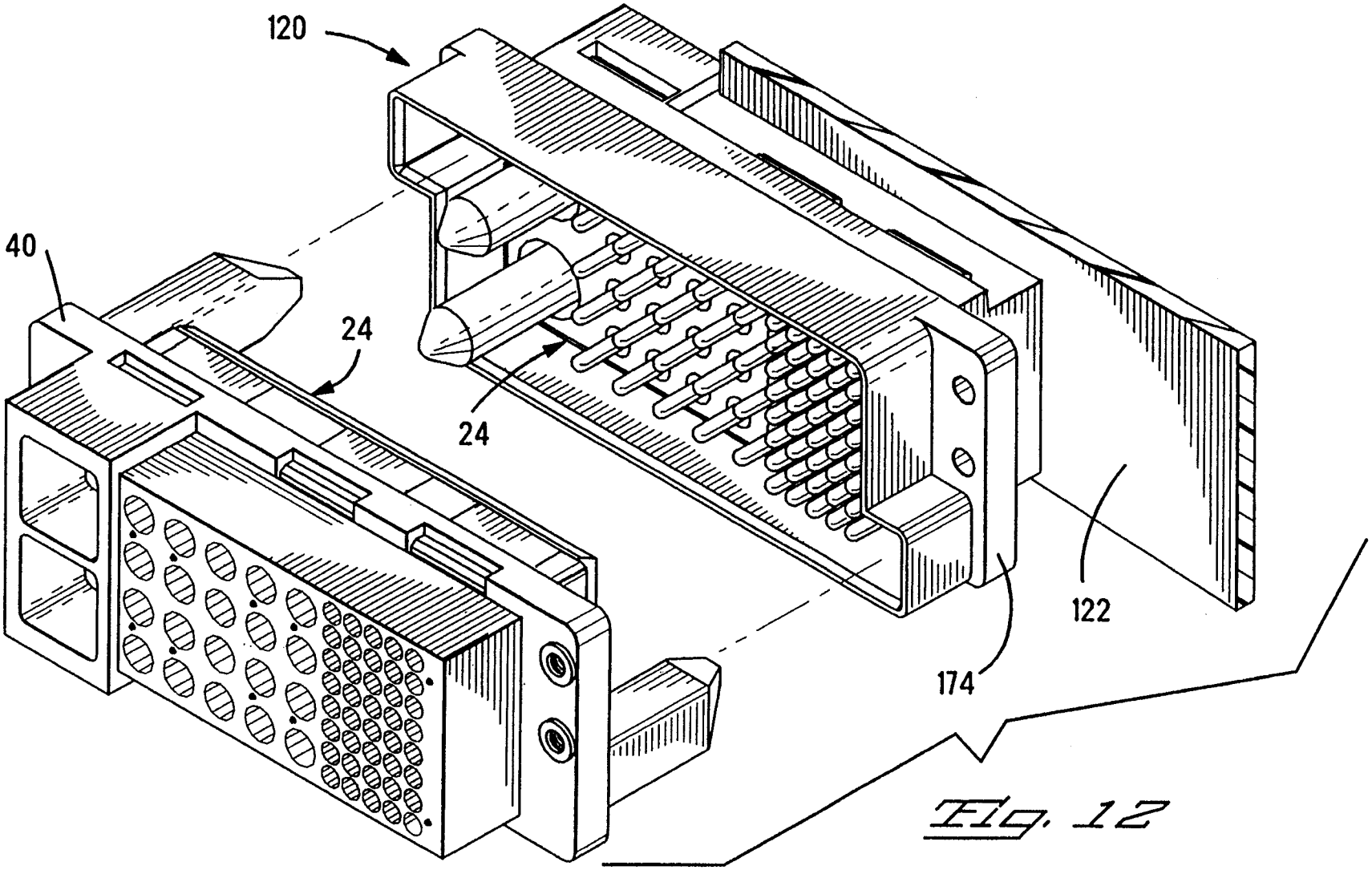
FIG. 12 is a respective view of an alternative embodiment of the present invention.

Rearward housing member 40 includes a forward face 42, a rearward face 44 and an array of passageways 46 extending therebetween. The array 46 corresponds to array 30 in the forward housing member 24 and includes a first group of passageways 48, a second group 50 and a third group 52. The passageways of the rearward housing member provide 40 a close fit for at least a portion of the contact loaded therein. Rearward housing member 40 further includes a plurality of latch arm passageways 54 extending from the forward housing to an outwardly extending flange 57 and guideposts 56 used in mating the first connector 22 to second connector 74 as known in the art. Forward housing member 24 is secured to rearward housing member 40 by inserting latch arms 38 into corresponding latch arm receiving passageways 54 of rearward housing member 40 until the lip 39 engages the rearward surface of flange 57 as shown in FIG. 1. The means of latching the front housing member to the rearward housing member allows the forward housing member to be removed by depressing the lip 39 until the lip 39 is below the engagement surface and the forward housing member 24 can be removed from the forward face of the rearward housing member. The housing passageways, furthermore, are configured so that terminals can be removed from the forward face as well as from the rearward face of the connector. When the connector is terminated to a cable, it is preferable to remove the terminals from the rear face of the connector by inserting a tool in the forward end to depress the spring latch arm. The terminal can be pulled rearwardly from the housing member. When the terminals are used in a connector that is mounted to a circuit board as shown in FIGS. 12 and 13, it is preferable that the terminals be removable from the forward part of the housing by desoldering at the selected location and removing the terminal from the forward end of the respective passageway.

Figure 4:
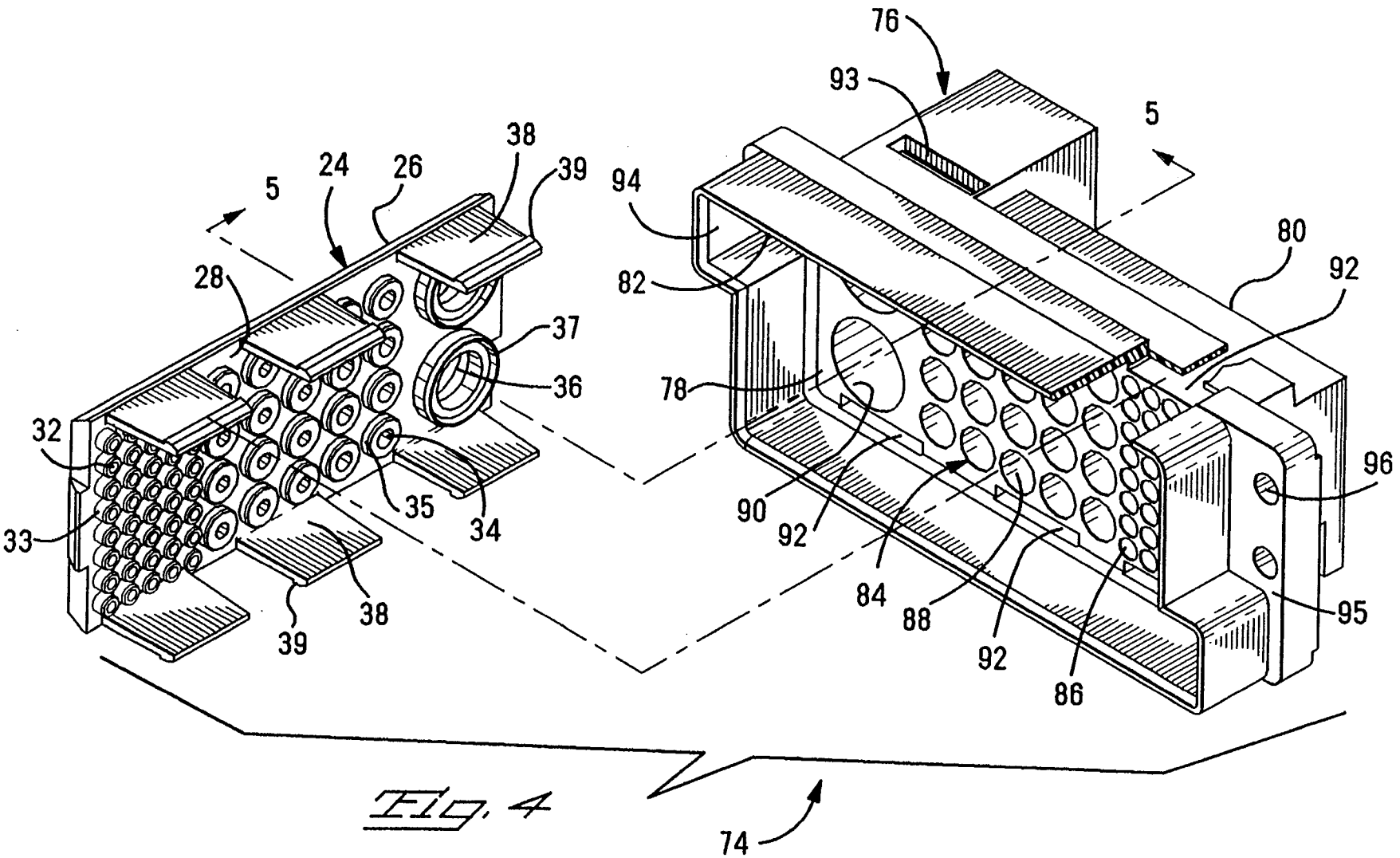
FIG. 4 is an exploded perspective view of the other half of the matable connector assembly of FIG. 1 with the forward housing exploded from the rearward housing and having the electrical terminals removed therefrom.
Figure 5:
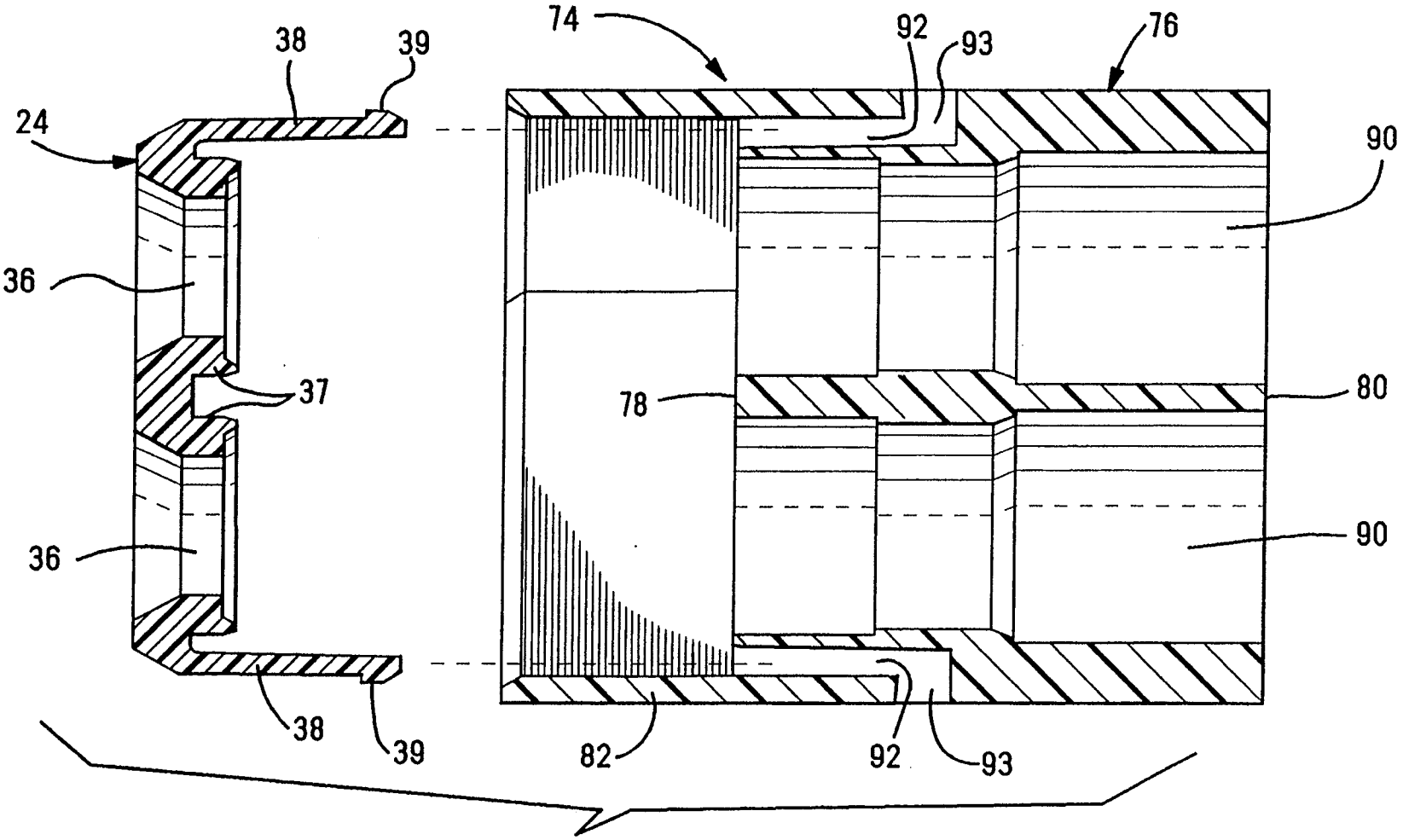
FIG. 5 is a cross-sectional view of the connector housing of FIG. 4 taken along the line 5—5 thereof.
Figure 5:
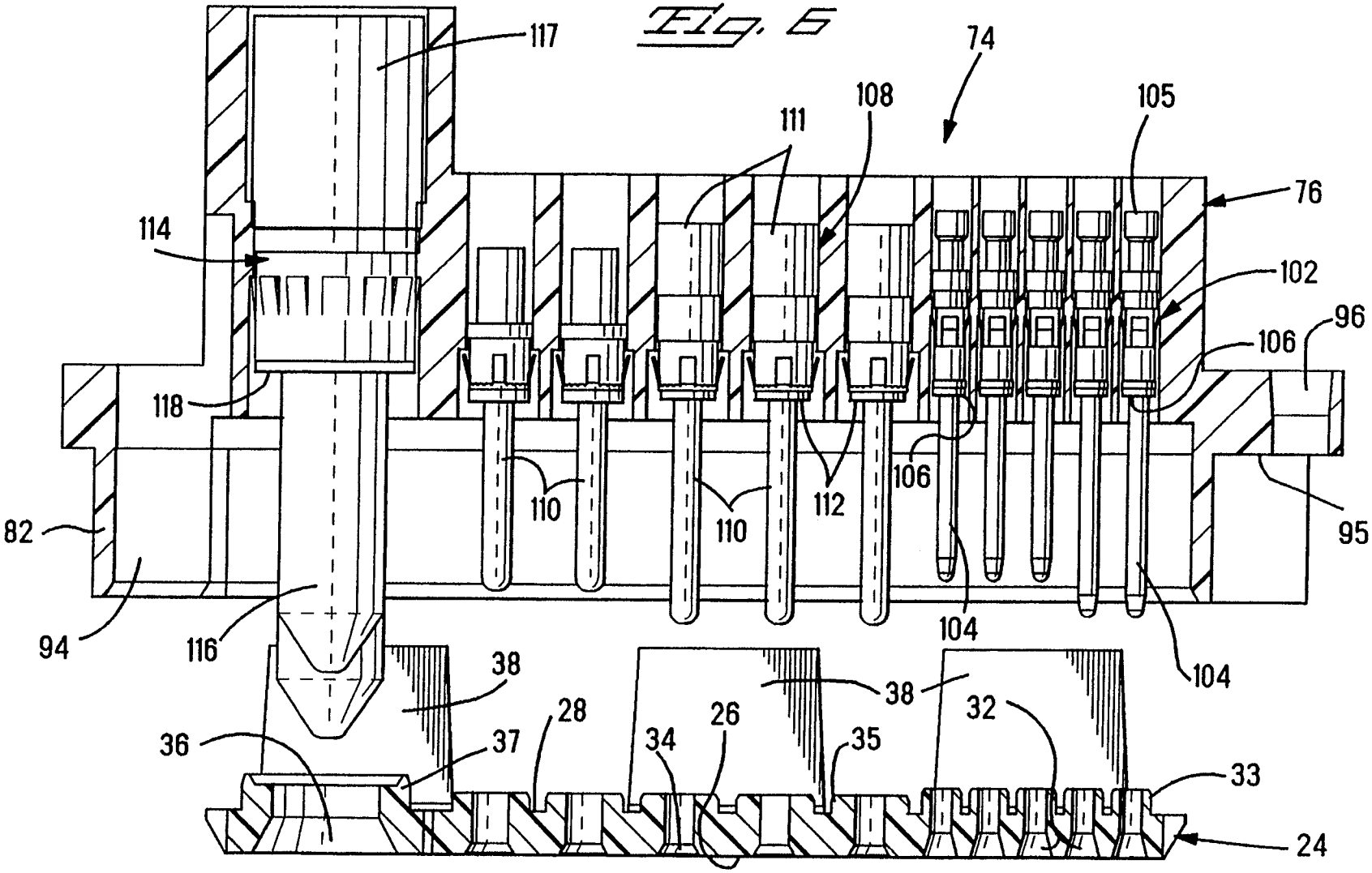

Referring to FIGS. 4 and 5, second connector 74 includes forward housing member 24 and rearward housing member 76. As previously discussed, in the preferred embodiment, the array of apertures 30 in housing member 24 are arranged symmetrically about a transverse axis A—A, as shown in FIG. 3, thereby enabling housing member 24 to be rotated about the transverse axis and thereby to be positioned to be secured to the rearward housing member 76 of the second connector 74. It is to be understood that the array of apertures in the connector assembly 20 need not be symmetrically arranged about a transverse direction. If they are not so arranged, it would be necessary to provide a separate forward housing member for the second connector.

Rearward housing member 76 includes a front face 78, a rear face 80 and a forward extending shroud 82. Rearward housing member 74 has an array 84 of terminal receiving passageways extending between front and rear faces 78, 80 respectively. The array 84 includes first, second and third groups of passageways 86, 88 and 90 respectively, which correspond to the groups of passageways 32, 34 and 36 respectively of forward housing member 24 and first connector rearward housing member 40. The respective passageways 86, 88 and 90 of the rearward housing member 76 provide a close fit for at least a portion of the terminals loaded therein. The rearward housing member 76 includes a plurality of latch arm receiving passageways 92 and guidepost receiving apertures 94 used when assembling the two connectors 22 and 74. Housing body 76 also includes aperture 93 which cooperates with the latching passageway 92 when assembling forward housing member 24 to rearward housing member 76.

Figure 8:
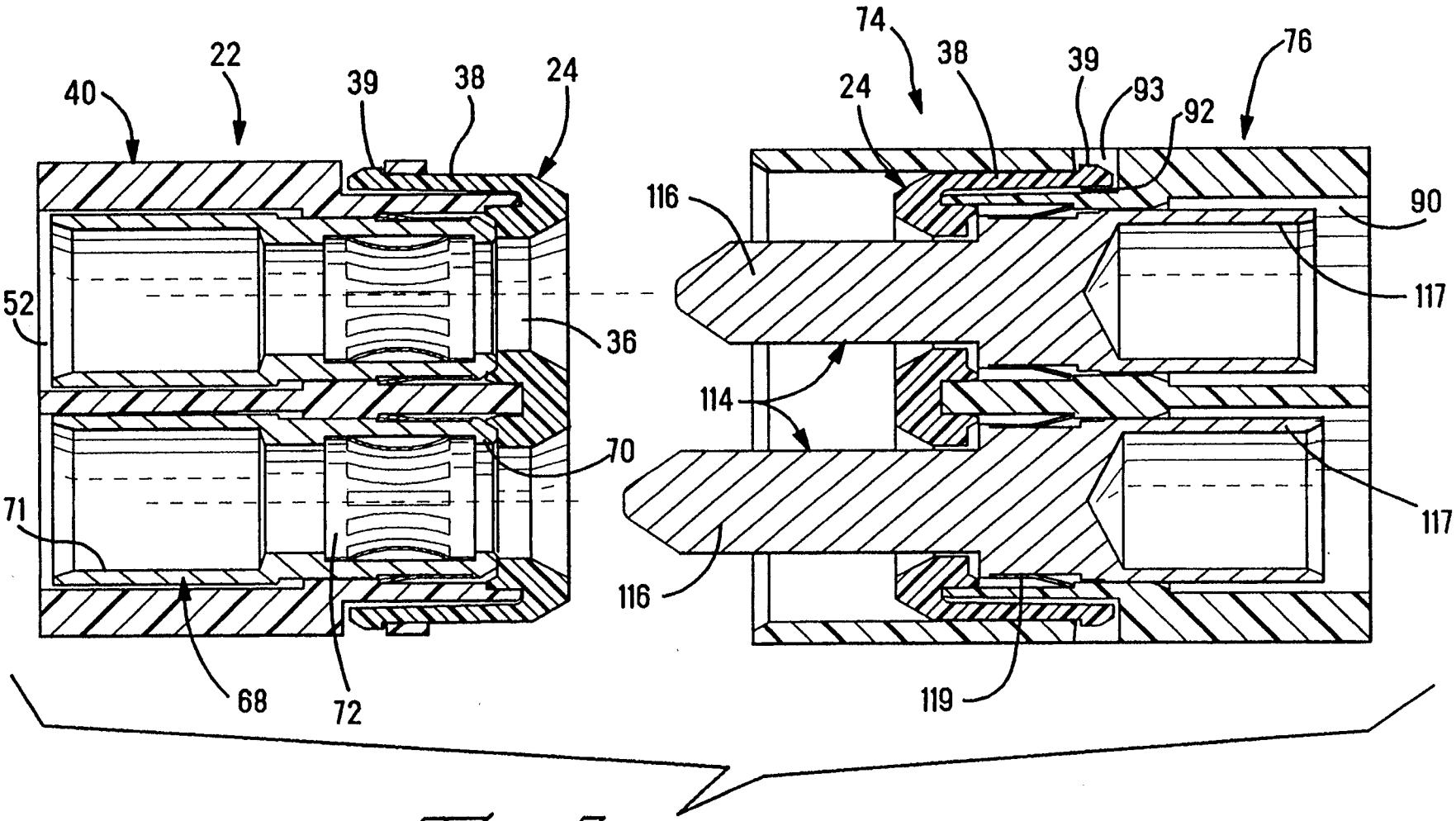
FIG. 8 is a cross-sectional view of the assembled connector assembly of FIG. 1 taken along line 8-8 thereof.
Figure 9:
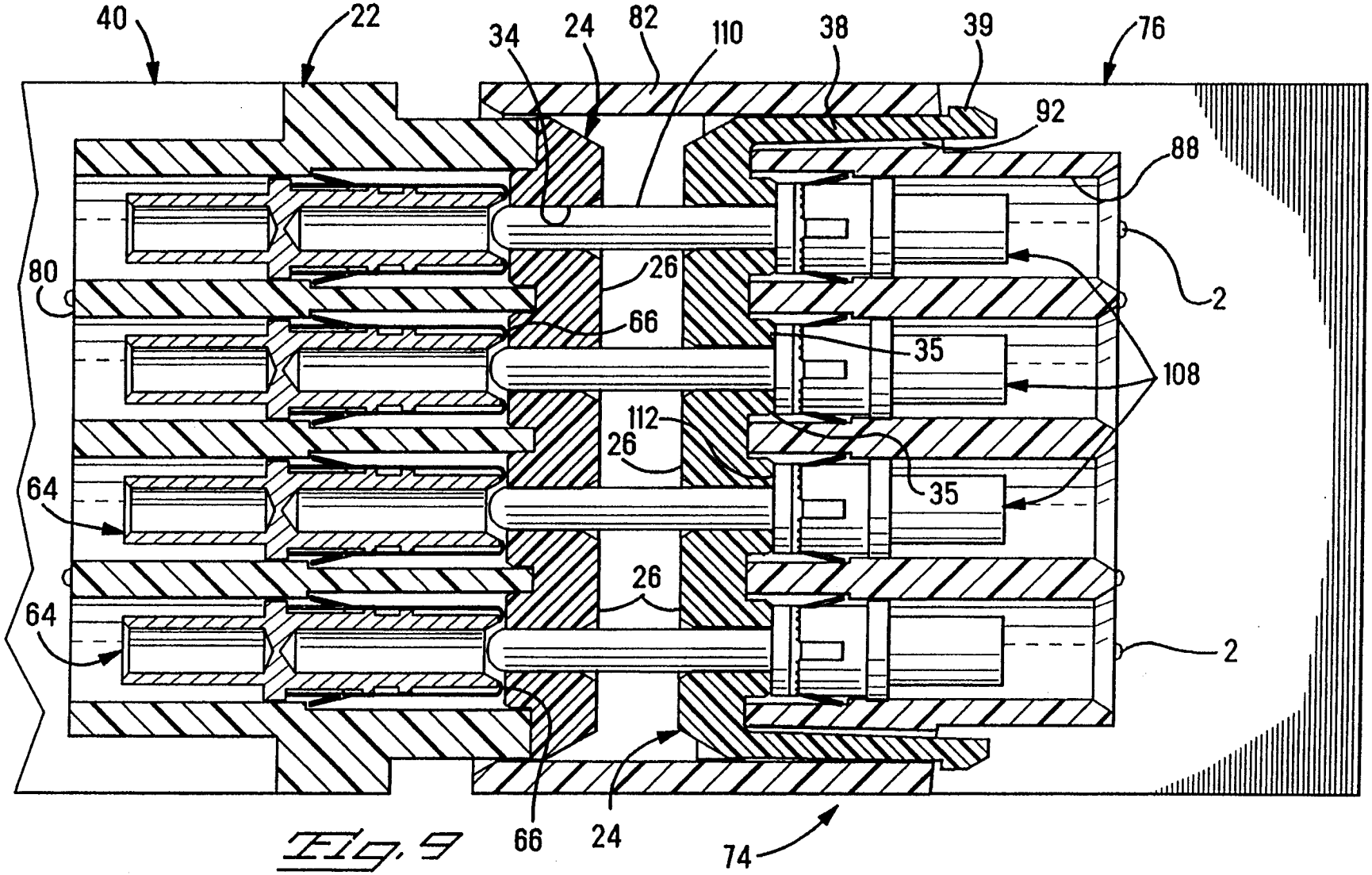
FIG. 9 is a cross-sectional view of the assembled connector of FIG. 1 taken along line 9—9 thereof.

The assembly of front housing 24 to second rearward housing member 76 is best understood by referring to FIGS. 4, 5, 6 and 7. FIG. 5 is a cross-sectional view of the forward housing member 24 and second rearward housing member 76 illustrating the third group of passageways 90. Latch arms 38 of forward housing member 24 are inserted between the walls of shroud 82 and into the corresponding latch arm receiving passageways 92 until the corresponding lips 39 enter the respective apertures 93 and are secured against a latching surface on rear of flange 95 as seen in FIG. 4. FIG. 8 also shows passageway 92 extending to an aperture 93 in housing wall. Aperture 93 provides access to release the lip 39 in this portion of the housing when forward housing member 24 is removed from the respective rearward housing 76. The remaining latch arms pass through the corresponding passageways 92 and are secured on the rearward surface of the flange as illustrated in FIGS. 1 and 9.

Figure 7:
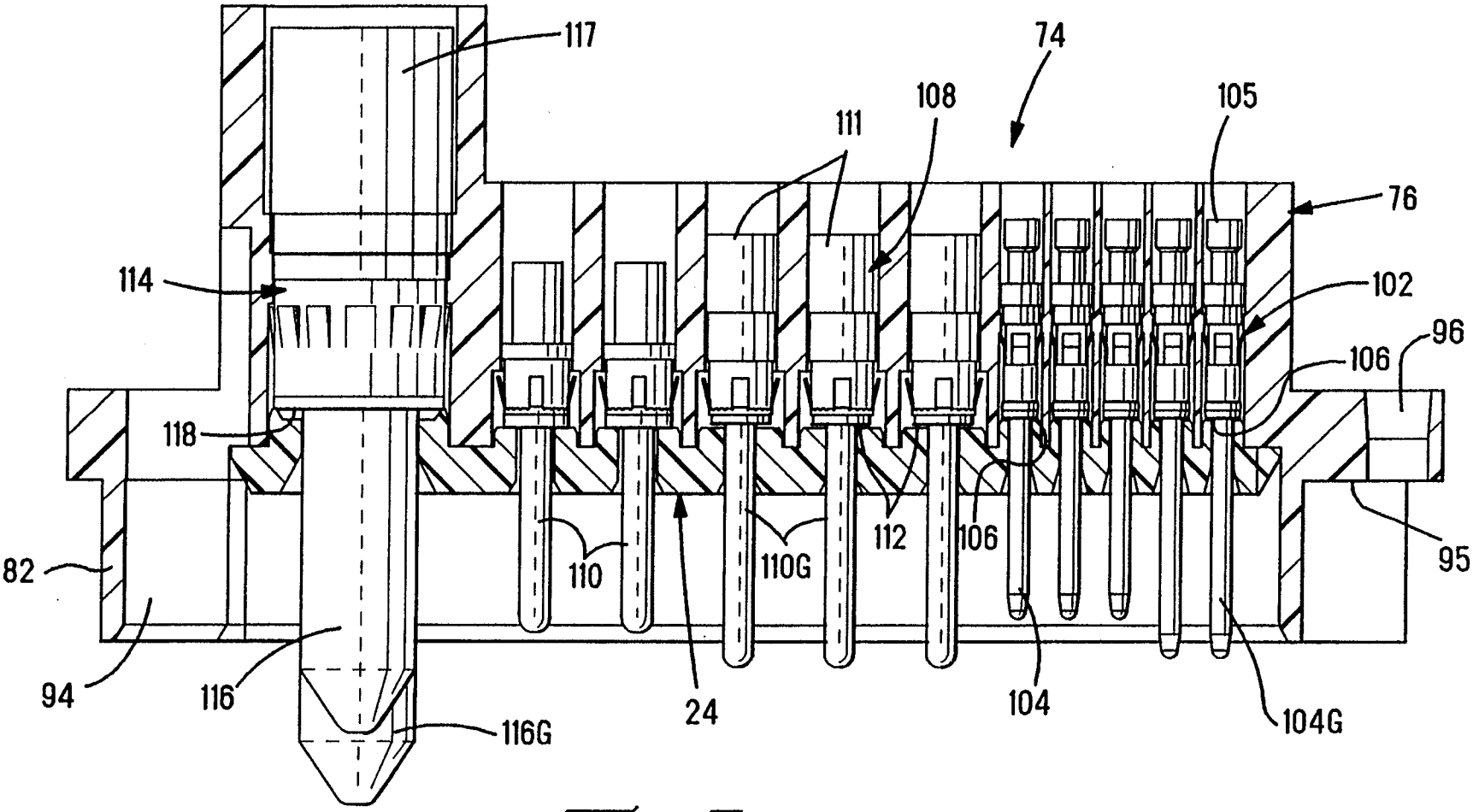
FIG. 7 is a view similar to that of FIG. 6 showing the forward and rearward housings assembled to each other.

FIGS. 6 and 7 are cross-sections which illustrate the assembly of forward housing member 24 to the assembled second connector 76. The second rearward connector 76 is shown with plurality of first, second and third electrical terminals 102, 108, and 114. For purposes of illustrating the invention, the wires that are terminated to the terminals 102, 108, and 114 have been omitted. The respective terminals 102, 108 and 114 have respective mating portions 104, 110 and 116; respective wire terminating portions 105, 111 and 117; and further include forward stop surfaces 106, 112 and 118 respectively.

FIGS. 6 and 7 also show the positioning of the respective contacts 102, 108 and 114 within the corresponding passageways 86, 88 and 90 of the housing 76. As can be seen in these figures, the housing passageways 86, 88 and 90 are configured to secure the respective spring arm portions of the terminals 102, 108, 114 by restraining rearward movement of the terminals within the respective passageways. FIGS. 6 and 7 further illustrate that the connector of the present invention provides for sequential mating of the terminals. As can be seen from these figures, the mating ends 104, 110 and 116 of the respective groups of pin terminals are not all the same length. In mating the two connectors 22, 76 the longer pin terminals will engage the corresponding socket in the mating connector first, followed by those terminals that are shorter. The present invention provides a means whereby selected positions can be loaded with terminals of various lengths depending upon the end use and the customer's application.

FIG. 7 shows the forward housing member 24 in position within the shroud 82 of second rearward housing member 76. As can be seen from this figure, the respective passageways 32, 34, 36 of forward housing member 24 are generally aligned with the corresponding rearward housing passageways 86, 88 and 90 respectively. The respective support extensions 33, 35 and 37 engage the corresponding stop surfaces 106, 112 and 118, thereby preventing forward movement of the terminals. Forward housing member 24 further provides sufficient distance between the mating face of the connector 22 and the leading ends of the socket terminals to meet safety requirements such as required by UL 1950/IEC950.

The forward housing 24 has more precisely dimensioned passageways 32, 34 and 36 to provide precisely located contact positions on the mating face of the connector assemblies. The support extensions 31, 33 and 35, in combination with the general positioning of the terminals 102, 108 and 114 within the rearward housing member 74, hold the mating portions 104, 110 and 116 of the respective contacts 102, 108 and 114 in precise alignment for mating with the corresponding connector 22 as seen in FIG. 9. Passageways 34 are seen to be dimensioned incrementally larger than the male contact sections 110 of male contacts 108 and are thus adapted for a close fit with the male contact sections forwardly of forward face 78 of rearward housing member 76 upon assembly.

FIGS. 8 and 9 illustrate the mating of first and second connector assemblies 22, 74. FIG. 8 shows an exploded view of the first assembly 22 in alignment for mating with the second assembly 76. FIG. 8 further shows the forward housing member 24 secured to the first connector rearward housing member 40 with the support extension 37 in engagement against leading ends of the socket terminals 68. As was previously described with respect to FIGS. 5 and 7, the precisely configured array 30 of passageways 32, 34, 36 in forward housing member 24 provides the alignment for the engagement of the pin terminals 114 of second connector 74 into the respective socket terminal members 68 of first connector 22.

It can be seen that with the rearward portion of the body sections of the male contacts 108 being closely engaged by rearward portions of passageways 88, that forward housing member 24 closely engaging male contact sections 110 establishes precise axial alignment of the male contact sections thereby aligning them with precisely positioned opposing passageways 34 of the opposing forward housing member 24 of the mating connector 22.

FIG. 9 shows a view of the partially mated assembled connectors through the second group of passageways 34, 50 and 34, 88. This figure illustrates the alignment of the corresponding pins and socket terminals held in precise alignment for completion of the mating of the connectors 22 and 76.

Figure 10:
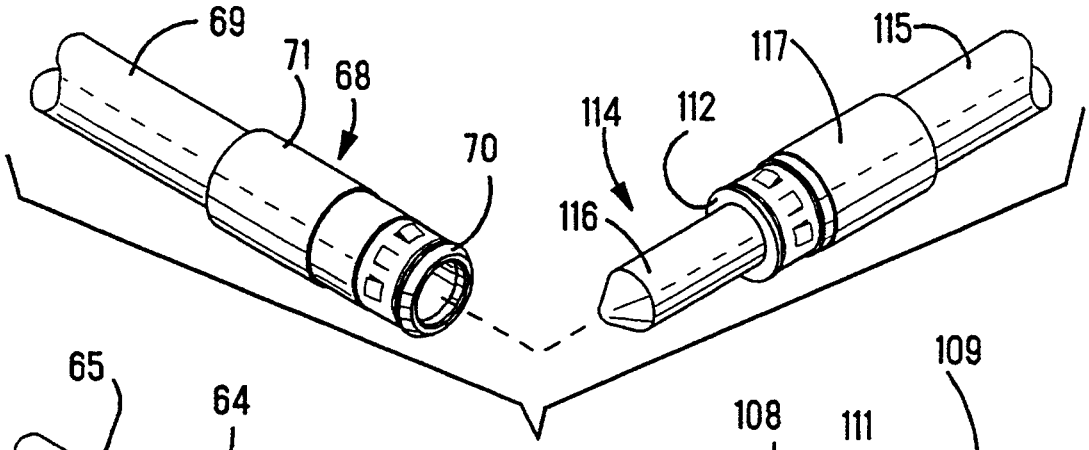
FIG. 10 is a view of representative contacts used in the connector.
Figure 11:
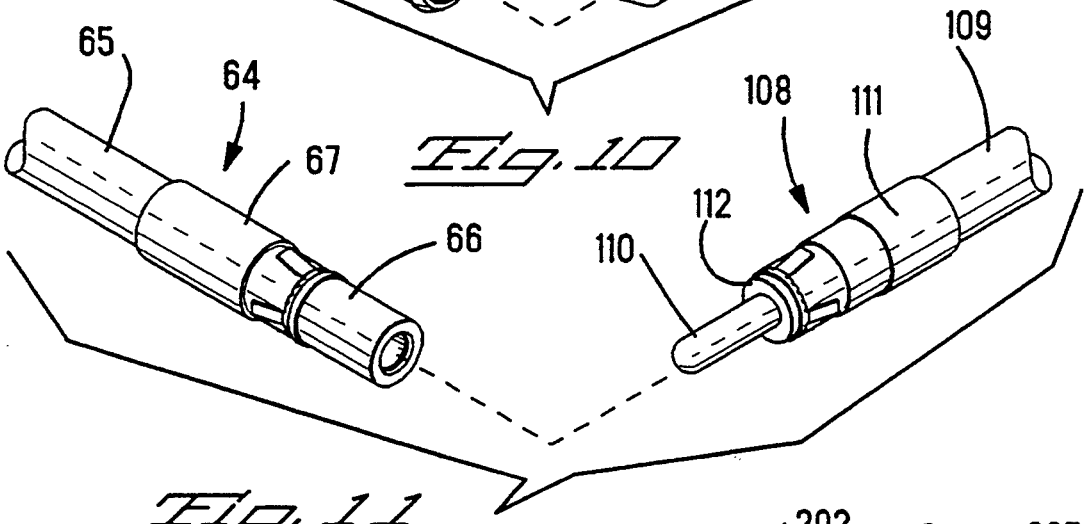
FIG. 11 is a view of another of the representative contacts used in the connector.

FIGS. 10 and 11 show representative mating terminals, 68,114 and 64, 108 terminated respectively to wires 69, 115, 65 and 109. Socket terminals 64, 68 include leading ends 70, 66, each adapted to be mated with a corresponding pin terminal 116, 110 respectively. As can be seen from figures, these terminals have spring arms on their outer surfaces for engaging surfaces within the housing as is known in the art and as shown in FIGS. 7 and 9. The terminals illustrated are pin and socket contacts. Suitable contacts for carrying levels of current such as 5 AMPs, for example, include Type II crimp pin and socket contacts size 16, and contacts for carrying 15 AMP include Type I, crimp pin and socket contacts size 12, both available from AMP Incorporated. Contacts such as those listed are found in AMP Incorporated Catalog 82-003 (Revision 8/91) pages 2002 and 2003. Suitable contacts for carrying 35 and 150 AMPs are of the type known as Louvertec-band contacts such as those listed in AMP Incorporated Catalogs 65408 and 65141.

FIGS. 12 and 13 show an alternative embodiment 120 of the invention wherein the second connector 174 is shown mounted to a circuit board 122. As can be seen from FIG. 13, the terminal members 202 have solder tails 205 which are soldered at 126 in holes 124 of a circuit board 122 or back panel.

It is thought that the multi-level hybrid connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A forward housing member for an electrical connector of the type having an array of contacts disposed within a dielectric housing assembly, with the contacts having body sections within respective passageways of a discrete rearward housing member, and with the contacts having forward contact sections adapted for male-female type axial mating upon mating of the connector with a complementary connector, the forward housing member comprising:

an integral member molded of dielectric plastic material having a generally plate-like body section with a short axial dimension between a forward face and a rearward face and an array of forward contact receiving passageways extending therethrough from said forward face to said rearward face, each said forward passageway having an annular flange extending rearwardly from said rearward face, said forward passageways being generally aligned with corresponding ones of the passageways of the rearward housing member upon full connector assembly, each said forward passageway being adapted to facilitate the mating of an associated pair of male-female contacts and having a selected transverse dimension only incrementally larger than the outer cross-sectional dimension of a male forward contact section of a corresponding male one of said pair of contacts matable thereat, and having a selected precise location associated with said corresponding male contact;

whererby said male contact section of said male one of said associated pair of contacts extends through a respective one of said annular flanges of said forward passageways in a close fit at least at a particular axial location therealong to mate with said female one of said associated pair of contacts, and said forward housing member defines a mating face of the resultant connector assembly wherein only the forward housing member need be precisely molded for precise positioning of said male contact sections of said male ones of said associated pairs of contacts for electrical connection with socket contact sections of said female contacts at precisely located contact positions across the mating face, whether said forward housing member is assembled to a rearward housing member containing the female contacts or to a rearward housing member containing the male contacts.

2. The forward housing member of claim 1 further comprising means for securing said forward housing member to said rearward housing member, said securing means including integral latch arms at least along each of two opposing sides of said forward housing member and extending rearwardly of said rearward face thereof, said arms being adapted to be received in complementary recesses of said rearward housing member and latchingly engage with complementary latching means of said rearward housing member.

3. The forward housing member of claim 1 wherein each said forward passageway includes a chamfered lead-in adjacent said forward face of said integral member, said respective lead-ins facilitating receipt thereinto of corresponding mating contacts during mating.

4. The forward housing member of claim 1 wherein said array of forward passageways includes at least two groups of different sized passageways, each group being adapted to receive contacts having different current carrying capabilities.

5. The forward housing member of claim 4 wherein respective passageways within each said group of passageways are located symmetrically with respect to at least one transverse dimension that transversely bisects said body section.

6. The forward housing member as set forth in claim 1 wherein said contacts disposed in said rearward housing member are said male contacts and include said male contact sections protruding forwardly of said forward face of the rearward housing member and received in a close fit through said forward passageways of said forward housing member, and rearward ends of said male contacts are closely held by said rearward passageways.

7. The forward housing member as set forth in claim 1 wherein said contacts disposed in said rearward housing member are said female contacts and include said socket contact sections slightly recessed within said rearward passageways from said forward face of said rearward housing member and include contact-receiving cavities forward ends thereof.

8. An electrical connector for use in mating a plurality of associated pairs of male-female contacts, comprising:

a rearward housing member, a forward housing member, means for securing said forward housing member to said rearward housing member along a forward face of said rearward housing member, and a plurality of contacts each including a body section and a forward contact section forwardly thereof, said rearward housing member having an array of rearward contact receiving passageways extending to said forward face, each said rearward passageway including a contact engaging surface cooperable with said body section of a respective one of said contacts and adapted to hold said respective one contact therein;

said body sections of said plurality of electrical contacts being disposed in respective ones of said rearward passageways;

said forward housing member being plate-like with a short axial dimension between a forward face and a rearward face and having an array of forward contact receiving passageways extending therethrough from said forward face to said rearward face, each said forward passageway having an annular flange extending rearwardly from said rearward face, said forward passageways being generally aligned with corresponding ones of said rearward passageways upon full connector assembly, each said forward passageway being adapted to facilitate the mating of an associated pair of male-female contacts and having a selected transverse dimension only incrementally larger than the outer cross-sectional dimension of a male forward contact section of a corresponding male one of said pair of contacts matable thereat, and having a selected precise locations associated with said corresponding male contact, whereby said male contact section of said male one of said associated pair of contacts extends through a respective one of said annular flanges of said forward passageways in a close fit at least at a particular axial location therealong to mate with said female one of said associated pair of contacts, and said forward housing member defines a mating face for said connector, wherein only the forward housing member need be precisely molded for precise positioning of said male contact sections of said male ones of said associated pairs of contacts for electrical connection with socket contact sections of said female contacts at precisely located positions at the mating face during connector mating.

9. The electrical connector of claim 8 wherein said means for securing said forward housing member to said rearward hosing member includes integral latch arms at least along each of two opposing sides of said forward housing member and extending rearwardly of said rearward face thereof, said arms being adapted to be received in complementary recesses of said rearward housing member and latchingly engage with complementary latching means of said rearward housing member.

10. The electrical connector of claim 8, wherein each said forward passageway includes a chamfered lead-in adjacent said forward face of said integral member, said respective lead-ins facilitating receipt thereinto of corresponding mating contacts during mating.

11. The electrical connector of claim 8 wherein said array of forward passageways includes at least two groups of different sized passageways, each group being adapted to receive contacts having different current carrying capabilities.

12. The electrical connector of claim 11 wherein respective passageways within each said group of passageways are located symmetrically with respect to at least one transverse dimension of said forward member that transversely bisects said body section.

13. The electrical connector as set forth in claim 8 wherein said contacts disposed in said rearward housing member are said male contacts and include said male contact sections protruding forwardly of said forward face of the rearward housing member and received in a close fit through said forward passageways of said forward housing member, and rearward ends of said male contacts are closely held by said rearward passageways.

14. The electrical connector as set forth in claim 8 wherein said contacts disposed in said rearward housing member are said female contacts and include said socket contact sections slightly recessed within said rearward passageways for said forward face of said rearward housing member and include contact-receiving cavities forward ends thereof.

* * * * *